United States Patent [19]

Drews et al.

[11] 4,345,562

[45] Aug. 24, 1982

[54] METHOD AND APPARATUS FOR REGULATING THE FUEL-AIR RATIO IN INTERNAL COMBUSTION ENGINES

[75] Inventors: Ulrich Drews, Vahingen-Pulverdingen; Peter Werner, Wiernsheim; Werner Möhrle, Stuttgart, all of Fed. Rep. of Germany

[73] Assignee: Robert Bosch GmbH, Stuttgart, Fed. Rep. of Germany

[21] Appl. No.: 148,435

[22] Filed: May 9, 1980

[30] Foreign Application Priority Data

May 12, 1979 [DE] Fed. Rep. of Germany ..... 2919220

[51] Int. Cl.[3] ..... F02B 3/00; F02B 33/00

[52] U.S. Cl. ..... 123/440; 123/489

[58] Field of Search ..... 123/489, 440

[56] References Cited

U.S. PATENT DOCUMENTS

| | | | |
|---|---|---|---|
| 4,202,301 | 5/1980 | Early | 123/440 |
| 4,208,993 | 6/1980 | Peter | 123/440 |
| 4,226,221 | 10/1980 | Asano | 123/440 |

*Primary Examiner*—Ronald B. Cox

*Attorney, Agent, or Firm*—Edwin E. Greigg

[57] ABSTRACT

A method and an apparatus for regulating the fuel-air ratio of the operational mixture of an internal combustion engine and for monitoring the operational readiness of a λ sensor controlling the regulating apparatus and functioning according to the principle of ionic conduction in fixed electrolytes. A constant reference voltage which approximately corresponds to the average sensor output voltage is connected opposite to the λ sensor. The level of the resultant voltage thus established, the values of which are disposed symmetrically relative to the reference voltage, is utilized, along with the cooperation of a resultant electric current which causes a voltage drop across the temperature-dependent internal resistance of the λ sensor as a gauge for the operational readiness of the λ sensor. The pickup of the resultant voltage is accomplished by two comparison devices, whose logically evaluatable output signals are transformed via a logical linkage circuit into an operational readiness or unreadiness signal. A third comparison device serves the purpose of controlling the regulating apparatus. The third comparison device output is switched when the λ sensor is not under the influence of any resultant electric current; as a result, no temperature-dependent shift of the switchover point relative to the internal sensor voltage occurs and regulation can be effected with the regulating apparatus in a temperature in dependent manner to a desired point in the sensor voltage curve or to a desired lambda value.

9 Claims, 3 Drawing Figures

METHOD AND APPARATUS FOR REGULATING THE FUEL-AIR RATIO IN INTERNAL COMBUSTION ENGINES

BACKGROUND OF THE INVENTION

The invention relates to a method and apparatus for controlling an operational mixture of fuel and air supplied to an internal combustion engine, and, more particularly, to a method and apparatus for regulating the fuel-air ratio of the mixture in accordance with the oxygen content of the engine exhaust gases.

In a known method and apparatus for regulating the fuel-air ratio of an operational mixture for an internal combustion engine, such as that disclosed in U.S. Pat. No. 4,208,993, issued June 24, 1980 to Peter, a λ sensor is connected with a regulating apparatus for influencing the fuel-air ratio. The λ sensor has a temperature-dependent internal resistance which influences the operational readiness of the λ sensor. In order to ascertain the operational readiness of the λ sensor, a reference voltage is supplied through a resistor to an output of the λ sensor to oppose the voltage signal generated by the λ sensor, and the resultant voltage at the λ sensor output is examined as to a minimum jump indicating the operational readiness of the λ sensor by two comparison devices having different threshold voltages. The output signals of the two comparison devices are logically linked and the signal resulting therefrom is evaluated as a standard for the operational readiness of the λ sensor by an evaluation circuit which generates a readiness signal or an unreadiness signal to enable or disenable a first functional mode of the regulating apparatus wherein the regulating apparatus is controlled by the λ sensor.

One of the comparison devices serves to ascertain whether the sensor signal is higher or lower than the reference voltage which determines the regulating point and which is located within the voltage jump of the λ sensor output signal when $\lambda=1$. The regulating device is controlled by the output signal of the comparator. A desired regulating point or a desired λ can be established with the aid of the regulating device when the reference voltage is located within the λ sensor voltage jump at $\lambda=1$. This arrangement has the disadvantage, however, that the effective switchover point of the comparator relative to the internal voltage of the λ sensor shifts in accordance with temperature; accordingly, because of the finite steepness of the λ sensor voltage jump at $\lambda=1$, the result is a temperature-dependent deviation from the desired control value of the control value actually generated at the output of the comparator.

OBJECT AND SUMMARY OF THE INVENTION

It is an object of the invention to provide a method and an apparatus for regulating the fuel-air ratio of an operational mixture of an internal combustion engine utilizing a λ sensor which is connected with a regulating apparatus for influencing the fuel-air ratio, and which further includes apparatus for monitoring the operational readiness of the λ sensor, similar to the known method and apparatus described above, wherein a temperature-dependent shift of the actual switchover point relative to the internal voltage of the λ sensor no longer occurs.

The method and apparatus of this invention is similar to the known method and apparatus described above, except that the two comparison devices are utilized solely to monitor the operational readiness of the λ sensor, and a third additional comparison device is utilized to ascertain whether the λ sensor signal is higher or lower than the constant reference voltage. The regulating device is controlled by the output signal of the third comparison device, which is switched between two voltage values, corresponding to values of the sensor signal which are higher than the reference voltage and values of the λ sensor signal which are lower than the reference signal, respectively. At the time the output signal of the third comparison device is switched, the voltage at the λ sensor output is equal to the reference voltage, so that no current flows through the resistor therebetween. Also, no current flows through the λ sensor, so that the λ sensor interval voltage supplied to the λ sensor output is not reduced by a voltage drop across the internal resistance of the λ sensor produced by current flowing therethrough. Thus, temperature-induced variations in the λ sensor internal resistance does not produce a shift of the actual switchover point of the third comparison device relative to the internal voltage of the λ sensor.

The invention will be better understood as well as further objects and advantages thereof will become more apparent from the ensuing detailed description of one preferred embodiment taken in conjunction with the drawings.

DESCRIPTION OF THE PREFERRED EMBODIMENT

The invention described hereinafter represents a further development of the method and apparatus described in the above referenced U.S. Pat. No. 4,208,993. The essential component of both this known apparatus and the apparatus according to the invention is a λ sensor of a known type, which is inserted into the exhaust system of an internal combustion machine and is there exposed to the flow around it of the exhaust gases resulting from combustion processes in the cylinders of the internal combustion engine. The sensor comprises a fixed electrolyte, such as zircon dioxide, having contacts on both sides. As a result of a partial oxygen pressure difference between the two surfaces of the fixed electrolyte, a potential difference occurs at the contacts. The output voltage at the λ sensor varies in abrupt fashion at an air number λ of 1. At air numbers less than 1, the output voltage at the λ sensor assumes a value in the range of 750–900 millivolts, assuming that the λ sensor is at normal operating temperature. At air numbers greater than 1, the output voltage is approximately 100 millivolts.

However, the λ sensor has the disadvantage in that when the λ sensor is cold, the internal resistance of the λ sensor is extremely high. Thus, no voltage signal which can be evaluated for the purpose of regulation, in particular one which appears as a clear voltage jump, can be attained at the output of the λ sensor. During the warmup phase of the engine, the output voltage of the λ sensor thus varies substantially.

Figure 1:
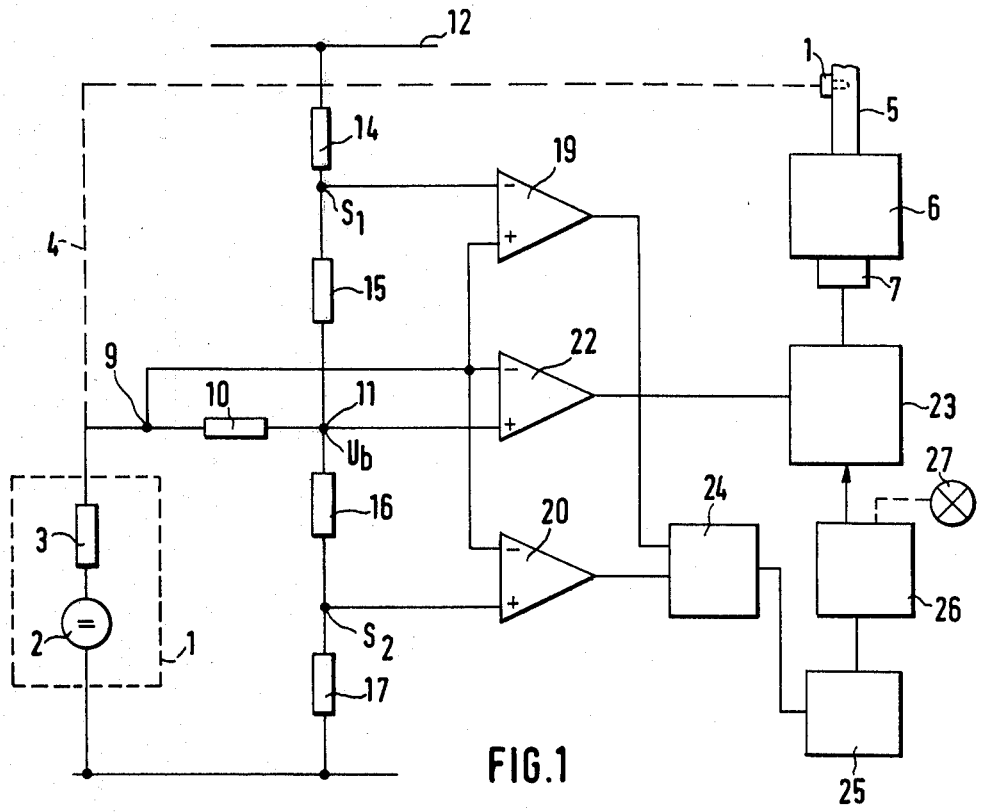
FIG. 1 is an electrical schematic diagram of an exemplary embodiment, shown in simplified form.

In FIG. 1, the λ sensor 1 is shown in the form of an equivalent circuit diagram comprising an internal voltage source 2 and an internal resistor 3. The connection 4 illustrated by broken lines indicates that the λ sensor 1 is inserted in the exhaust system 5 of an internal combustion engine 6, which is shown here only in schematic form. The engine is supplied with an operating mixture of fuel and air, which enters the combustion chambers of the engine in order to be burned there, by means of a fuel-air metering device 7. The ratio of fuel to air can be established in a controlled manner in the fuel-air metering device 7 and can be corrected in addition by means of the apparatus shown in FIG. 1.

In the interests of keeping toxic exhaust emissions as low as possible, an attempt is made to have the overlying regulating device for fuel or air metering become functional as soon as possible after the engine has been started. In order to recognize when a λ sensor signal appears which is capable of being evaluated with sufficient reliability by the regulating apparatus, a circuit has been proposed in the above reference U.S. Pat. No. 4,208,993 in which a λ sensor output voltage varying with the λ sensor internal resistance is picked up with the aid of threshold switches, and after fixed threshold voltages have been exceeded a signal is generated which puts the regulation process into effect. FIG. 1 includes the essential elements of this circuit.

One output of the λ sensor 1 is connected to the ground line, while the other output is connected via a resistor 10 with a middle terminal 11 of a reference voltage divider. The reference voltage divider is supplied with electric current by a constant voltage source or a constant current source, of which the positive supply lead 12 is shown in FIG. 1. The voltage divider includes four resistors 14, 15, 16 and 17 disposed in series; naturally, each individual resistor 14, 15, 16, 17 may include several interconnected resistive elements. The middle terminal 11 at which the voltage $U_b$ is generated, is located between the two middle resistors 15 and 16. A terminal for a threshold voltage $S_1$ is located between the resistors 14 and 15 of the upper branch of the voltage divider. This terminal $S_1$ is located between the resistors 14 and 15 of the upper branch of the voltage divider. This terminal $S_1$ is connected to the inverting input of an operational amplifier 19, which in terms of its function is effectively disposed as a threshold switch. The noninverting input of the operational amplifier 19 is connected to the λ sensor output 9. Between the resistors 16 and 17 of the lower branch of the voltage divider, a terminal $S_2$ is provided for a second threshold voltage, which is connected to the noninverting input of a second operational amplifier 20, which, like the first operational amplifier 19, is embodied as a threshold switch and represents a second comparison device or comparator. The inverting input of the second operational amplifier 20 is connected to the λ sensor output 9.

A third operational amplifier 22, also embodied as a threshold switch, is further provided, its inverting input being connected to the λ sensor output 9 and its noninverting input being connected to the middle terminal 11. The third operational amplifier 22 represents the third comparison device or comparator. Its output is connected to a regulating circuit 23, which produces a control signal for the fuel-air metering device 7.

The output of the first operational amplifier 19 and the second operational amplifier 20 lead to a logical linkage circuit 24, the output of which is carried via a timing circuit 25 to an evaluation circuit 26. The output of the evaluation circuit 26 also acts upon the regulating circuit 23 and can additionally trigger a warning device 27. Naturally, it is possible instead for only one of the two to be controlled.

The described apparatus functions as follows:

A constant reference voltage $U_b$ is available at the middle terminal 11 of the reference voltage divider and has a polarity which is identical to that of the λ sensor output voltage at the λ sensor output 9. The reference voltage 11 is applied via the resistor 10 to the λ sensor output 9 to thus oppose the λ sensor internal voltage 2. Accordingly, at the λ sensor output 9, a differential voltage $S_r$ resulting from both voltages $U_b$, 2 is thus produced, which assumes the value of the reference voltage $U_b$ so long as no current is flowing between the λ sensor 1 and the reference voltage point 11. When the λ sensor output voltage is deviating, there is a flow of electric current, via the resistor 10 and the internal resistor 3, either into or out of the λ sensor 1. The volrage $S_r$, which is thus produced at the sensor output 9, lies between the reference voltage value $U_b$ and the maximum or minimum value of the λ sensor internal voltage 2. This voltage $S_r$ is dependent on the internal resistance 3 of the λ sensor 1, which greatly influences the flow of electric current through the λ sensor 1.

As a result of the reference voltage $U_b$ being supplied to the λ sensor output 9 through the constant resistor 10 in opposition to the λ sensor internal voltage 2 supplied to the λ sensor output 9 through the λ sensor internal resistance 3, as the λ sensor temperature increases and the λ sensor internal resistance 3 correspondingly decreases, the voltage $S_r$ appearing at the λ sensor output 9 increasingly deviates from the reference voltage $U_b$, with the upper and lower values of the voltage $S_r$ being symmetrically disposed relative to the reference voltage $U_b$. Beyond a certain minimum deviation $/\Delta U/=/S_r-U_b/$, typically 25 millivolts, the λ sensor output signal may be considered to be evaluatable for a subsequent regulation. The λ sensor internal resistance 3 is then low enough so that the λ sensor signal can be evaluated without error by a subsequent comparator for regulating purposes.

Figure 3:
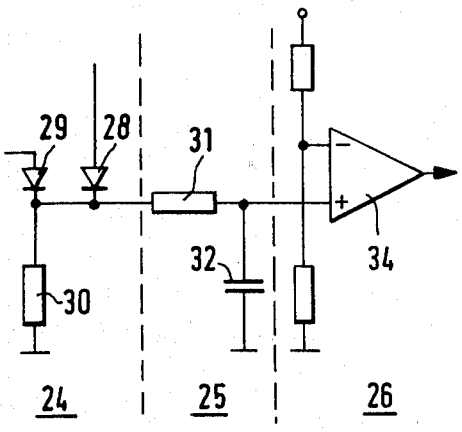
FIG. 3 is an electrical schematic diagram of one embodiment of the logic circuit 24, the timing 25 and the evaluation circuit 26, which are shown in block form in FIG. 1.

The cited minimum deviations ΔU from the reference voltage $U_b$ are determined by means of the threshold voltages $S_1$ and $S_2$ of the reference voltage divider; the internal resistance 3 of the λ sensor 1 at which the regulating circuit switches on is in addition determined by the resistance value of the resistor 10. The first operational amplifier 19 and the second operational amplifier 20 serve the purpose of logical evaluation of the λ sensor output voltage appearing at the λ sensor output 9. If the voltage at the λ sensor output 9 exceeds the threshold voltage $S_1$, then the first operational amplifier 19 emits a signal of logical 1 and the second operational amplifier 20 emits a signal of logical 0. If instead, the voltage at the sensor output 9 is lower than the threshold $S_2$, when the output of the first operational amplifier 19 is logical 0 and the output of the second operational amplifier 20 is logical 1. These output signals are carried to the logical linkage circuit 24, which is shown in more detailed from in FIG. 3. FIG. 3 also includes the timing circuit 25 and the evaluation circuit 26.

Figure 2:
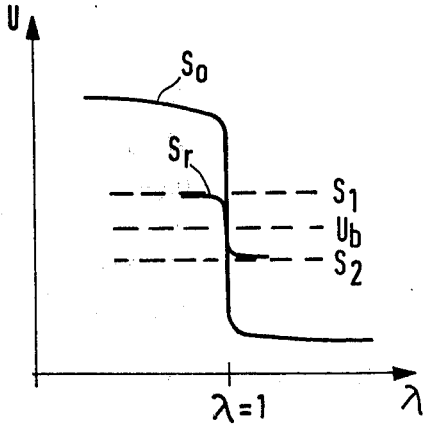
FIG. 2 is a diagram showing the course of the λ sensor output voltage with a varying lambda.

FIG. 2, with the aid of a diagram, serves to explain the mode of operation of the monitoring apparatus described above. The λ sensor internal voltage $S_o$, as described above, assumes a larger value at λ values of less than 1, drops abruptly at λ=1, and assumes a low value at λ values greater than 1. When the λ sensor 1 is cold, as illustrated in FIG. 2, the resultant voltage $S_r$ appearing at the λ sensor output 9 lies either below the threshold voltages $S_1$ or above the threshold voltage $S_2$.

At the output of the first operational amplifier 19 and at the output of the second operational amplifier 20, logical signals thus appear in accordance with the following table:

| Sensor State | $S_o$ | First Operational Amplifier (19) | Second Operational Amplifier (20) |
|---|---|---|---|
| COLD | $S_o > U_b$ | 0 | 0 |
| COLD | $S_o < U_b$ | 0 | 0 |
| WARM | $S_o > U_b$ | 1 | 0 |
| WARM | $S_o < U_b$ | 0 | 1 |

The values for the cold λ sensor at the output of the operational amplifiers 19, 20 also apply to the case where the connection between the λ sensor 1 and the sensor output 9 has been broken.

From the table, it will be appreciated that when there is a 0 signal at the outputs of the first and second operational amplifiers 19 and 20, the λ sensor 1 is not operationally ready, and when there is a different output at one operational amplifier from that at the other the sensor is operationally ready. The output signals are evaluated in the embodiment shown in FIG. 3 by means of an OR circuit. A first diode 28 of the OR circuit is connected to the output of the first operational amplifier 19, while a second diode 29 of the OR circuit is connected to the output of the second operational amplifier 20. The cathodes of the diodes 28 and 29 are connected first via a resistor 30 to ground and second via a resistor 31 to a capacitor 32, which on the other side is also connected to ground. When the λ sensor 1 is ready for operation, the timing circuit 25 including the resistor 31 and the capacitor 32 is exposed to a 1 signal in alternation by this OR circuit, via diodes 28 and 29, respectively; thus either the capacitor 32 can charge via the resistor 31, or, once charged, it remains in the charged state. If no 1 signal appears at one of the operational amplifiers 19 or 20, then the capacitor 32 can discharge via the resistors 31 and 30, the capacitance and the resistance values determining the discharge time.

The evaluation device 26 comprises a comparator 34, at whose one input a reference voltage value is applied and at whose other input the capacitor 32 voltage is present. With the aid of the reference voltage value, a predetermined portion of the discharge time of the timing circuit 25 can be established as a delay time; that is, after this delay has elapsed since the last appearance of a 1 signal at one of the two diodes 28 or 29, the comparator 34 switches over and generates a control signal which intervenes in a suitable manner in the regulating circuit 23 and/or triggers the warning device 27. With this switchover of the comparator 34, the regulating apparatus is put out of operation and the operational mixture delivered by the fuel-air metering device 7 to the engine is controlled thereafter in open-loop fashion only.

In the monitoring circuit described above as prior art, which has only a first and a second operational amplifier corresponding to the operational amplifiers 19 and 20 but not the third operational amplifier 22, one of the operational amplifiers 19 and 20 acts as a comparator, whose output signal serves the purpose of triggering the logical evaluation circuit and in addition the regulating apparatus provided in the apparatus 23 according to the invention. This apparatus 23, in known fashion, has an integrator whose integration device is controlled by the output signal of the operational amplifier. The fuel-air ratio of the operational mixture is corrected via a suitable device in accordance with the integrator output signal. Apparatuses of this kind, however, are generally known (see German laid-open application Nos. 22 02 614 or 25 17 269) and need not be described in detail here. The activity of the integrator is shut off by the output signal of the evaluation circuit 26 and a fixed value is established at the integrator output.

If in the known apparatus the first operational amplifier 19, for instance, has the additional task of controlling the regulating apparatus 23, then the threshold voltage $S_1$ must be disposed such that it corresponds to a desired λ value within the sensor voltage jump. Because the jump of the λ sensor output voltage is not infinitely steep, the λ value can be varied within narrow limits by means of the disposition of the threshold voltages 1. In this known embodiment, however, the disadvantage appears that at the switchover point at which the resultant voltage $S_r$ at the λ sensor output 9 has attained the threshold voltage $S_1$, the λ sensor internal voltage $S_o$ is greater than the reference voltage $U_b$. This means that an electric current flows out of the λ sensor and causes a voltage drop across the resistor 10 corresponding to the difference between the voltages $S_1$ and $U_b$. Assuming the input currents of the amplifiers 19, 20 are as low as desired, since the same current which flows through the resistor 10 also flows through the internal sensor resistor 3, the λ sensor internal voltage $S_o$ must therefore assume a higher value, dependent on the internal resistance 3, in order for the resultant voltage $S_r$ to attain the threshold voltage $S_1$. Because the λ sensor internal resistance 3 varies greatly in accordance with temperature, shifts occur in the switching point which are dependent on the λ sensor temperature, causing an uncontrolled switching point error. A source of error such as this is particularly insupportable when it is necessary for the values attained to be of maximum precision.

In the embodiment according to the invention, the third operational amplifier 22 is now provided, which switches over whenever the voltage at the sensor output 9 either exceeds or falls below the reference voltage $U_b$. At the switchover time, the voltage values at point 9 and 11 are identical, so that no electric current flows through the resistor 10. The λ sensor internal voltage $S_o$ is accordingly not adulterated by a voltage drop across the internal resistor 3. The reference voltage $U_b$, in this case, indicates the switchover point or the λ value which the regulation procedure is intended to establish. The regulation circuit 23 is triggered here exclusively by the operational amplifier 22. Adulteration of the regulation threshold voltages by the monitoring circuit is thus prevented in an advantageous manner.

In the illustrated example, the first operational amplifier 19 is switched as a noninverting amplifier or threshold switch, while the second operational amplifier 20 is switched as an inverting amplifier or threshold switch. Accordingly, then the λ sensor 1 is not operationally ready, that is, when the resultant voltage $S_r$ is disposed within the voltage band defined by the threshold voltages $S_1$ and $S_2$, logical signals appear at the outputs of the first and second operational amplifiers 19, 20 which are both logical 0. In contrast, when the λ sensor is operationally ready, the output signals of the operational amplifiers 19, 20 are different. An OR gate can be used here for the purpose of evaluation. If, however, the first comparator 19 and the second comparator 20 are switched identically, then when the λ sensor 1 is not operationally ready different signals appear at the outputs of the comparators 19, 20 while identical signals appear when the λ sensor 1 is operationally ready. In this case, evaluation can again be performed with an OR gate, one of the signals being first inverted. The timing circuit 25 serves the purpose of preventing the shutoff of the regulating circuit 23 during the transition from $\lambda<1$ to $\lambda>1$ and vice versa, when $S_2<S_r<S_1$. The switchover from closed-loop control to open-loop control with the aid of the evaluation circuit 26 is only made if the disturbance causing operational unreadiness of the λ sensor 1 persists for a relatively long period of time.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In a method of regulating the fuel-air ratio of the operational mixture intended for combustion in an internal combustion engine utilizing a λ sensor, which is connected with a regulating apparatus for influencing the fuel-air ratio, and further having an apparatus for monitoring the operational readiness of the λ sensor, wherein in order to ascertain the internal sensor resistance influencing the operational readiness of the sensor a reference voltage, with the interposition of a resistor, is supplied to an output of the λ sensor to oppose the λ sensor voltage and the resultant voltage at the λ sensor output is examined as to a minimum jump indicating the operational readiness of the λ sensor by means of two comparison devices having different threshold voltages whose output signals are logically linked and the signal resulting therefrom is evaluated as a standard for the operational readiness by an evaluation circuit which generates a first signal, indicating the operational readiness of the λ sensor, and a second signal indicating the operational unreadiness of the λ sensor, the improvement which comprises the steps of:

comparing the resultant voltage with the reference voltage and generating a comparison signal indicating the disposition of the resultant voltage relative to the reference voltage; and transforming the comparison signal into a correction signal for varying the fuel-air ratio, utilizing the regulating apparatus, which is connected to receive the comparison signal.

2. A method as defined by claim 1, which further comprises the step of disabling a first functional mode of the regulating apparatus upon the occurrance of the second control signal of the evaluation circuit indicating the λ sensor is in a state of operational unreadiness.

3. A method as defined by claim 2, which further comprises the step of delaying the transmission of the signal resulting from the logical linkage of the output signals of the two comparison devices to the evaluation circuit.

4. An apparatus for regulating the fuel-air ratio of an operational mixture of fuel and air supplied to an internal combustion engine for combustion therein, which comprises:

λ sensor means for generating at its output a voltage signal related to the air number (λ) of the engine exhaust gases;

a reference voltage source for supplying a constant reference voltage of the same polarity as the λ sensor means signal;

a first threshold voltage source for supplying a first threshold voltage having a value higher than the reference voltage;

a second threshold voltage source for supplying a second threshold voltage having a value lower than the reference voltage;

a resistor connected between the reference voltage source and the λ sensor means output;

first, second and third signal comparators, each having two inputs and an output, one input of each comparator being connected to the λ sensor means output, the other input of the first comparator being connected to the first threshold voltage source, the other input of the second comparator being connected to the second threshold voltage source, and the other input of the third comparator being connected to the reference voltage source;

a logical linkage circuit having two inputs connected respectively to the outputs of the first and second comparators, and having an output;

evaluation circuit means, having an input connected to the output of said logical linkage circuit, for generating a first output signal indicating the operational readiness of the λ sensor means or a second output signal indicating the operational unreadiness of the λ sensor means; and regulating apparatus means for influencing the fuel-air ratio of the operational mixture, which is connected with the output of the third comparator.

5. An apparatus, as defined by claim 4, which further comprises a constant voltage source and a voltage divider connected to the constant voltage source, the voltage divider having three voltage pickups, or terminals, which constitute the reference voltage source, the first threshold voltage source, and the second threshold source, respectively.

6. An apparatus as defined by claim 5, characterized in that at the switching point of the third comparator no electric current flows through the λ sensor means.

7. An apparatus as defined by claim 1, characterized in that a timing circuit is disposed between the logical linkage circuit and the evaluation circuit.

8. An apparatus as defined by claim 4, characterized in that:

the one input of the first comparator connected to the λ sensor means output corresponds functionally to the other output of the second comparator connected to the second threshold voltage source; and the logical linkage circuit detects identity or non-identity of the first comparator output signal relative to the second comparator output signal, as a gauge for whether the sensor means output signal falls within or without, respectively, the voltage range represented by the first and second threshold voltages.

9. An apparatus as defined by claim 4, characterized in that:

the one input of the first comparator connected to the λ sensing means output corresponds functionally to the one input of the second comparator connecting to the λ sensing means output; and the logical linkage circuit detects non-identity or identity of the first comparator output signal relative to the second comparator output signal, as a gauge for whether the λ sensor means output signal falls within or without, respectively, the voltage range represented by the first and second threshold voltages.

* * * * *